US007597479B2

(12) United States Patent
Zimmerman et al.

(10) Patent No.: US 7,597,479 B2
(45) Date of Patent: Oct. 6, 2009

(54) STORAGE BAG WITH FLUID SEPARATOR

(75) Inventors: Dean Zimmerman, West Chester, OH (US); Carl L. Bergman, Loveland, OH (US)

(73) Assignee: The Glad Products Company, Oakland, CA (US)

( * ) Notice: Subject to any disclaimer, the term of this patent is extended or adjusted under 35 U.S.C. 154(b) by 134 days.

(21) Appl. No.: 11/039,735

(22) Filed: Jan. 20, 2005

(65) Prior Publication Data

US 2006/0159576 A1 Jul. 20, 2006

(51) Int. Cl.
*B65D 33/01* (2006.01)
*B65D 33/16* (2006.01)
*B65B 3/17* (2006.01)

(52) U.S. Cl. ..... 383/103; 383/63; 141/7; 206/524.8

(58) Field of Classification Search ..... 383/103, 383/63, 100; 206/524.8; 141/7, 8, 10, 65
See application file for complete search history.

(56) References Cited

U.S. PATENT DOCUMENTS 2,576,322 A 11/1951 Waters
2,649,234 A 8/1953 Taunton
2,778,171 A 1/1957 Taunton
2,778,173 A 1/1957 Taunton
2,870,954 A 1/1959 Kulesza
3,762,404 A * 10/1973 Sakita ..... 602/6
3,799,427 A * 3/1974 Goglio ..... 383/103
3,929,178 A * 12/1975 Hickey ..... 206/524.8
3,980,226 A 9/1976 Franz
4,295,566 A 10/1981 Vincek
4,310,118 A 1/1982 Kisida et al.
4,337,804 A * 7/1982 Maruscak ..... 141/65
4,419,373 A * 12/1983 Oppermann ..... 426/234
4,702,376 A 10/1987 Pagliaro
4,715,494 A 12/1987 Heitzenrioder et al.
4,756,422 A * 7/1988 Kristen ..... 206/524.8
5,142,970 A * 9/1992 ErkenBrack ..... 99/472
5,228,271 A 7/1993 Wallace
5,332,095 A 7/1994 Wu
RE34,929 E 5/1995 Kristen
5,450,963 A 9/1995 Carson
5,480,030 A 1/1996 Sweeney et al.

(Continued)

FOREIGN PATENT DOCUMENTS

JP 01279073 A 11/1989

(Continued)

*Primary Examiner*—Timothy L Maust
*Assistant Examiner*—Nicholas A Arnett
(74) *Attorney, Agent, or Firm*—Thomas C. Feix

(57) ABSTRACT

The storage bag includes an interior volume for containing food items and a one-way valve element through which air from the interior volume can be evacuated. To prevent fluids and juices from the stored food items from contaminating the valve element, a separator defining a chamber is included that sealingly connects the valve element to the interior volume. In the separator, fluids and juices separate from the evacuating air by gravitational separation and are returned to the interior volume. In an embodiment, to facilitate packaging and distribution of multiple storage bags, the separator is adjustable between an expanded position for providing the chamber and a collapsed position substantially eliminating the chamber.

19 Claims, 5 Drawing Sheets

U.S. PATENT DOCUMENTS

| | | | | | |
|---|---|---|---|---|---|
| 5,544,752 | A | | 8/1996 | Cox | |
| 5,584,409 | A | * | 12/1996 | Chemberlen | 220/89.1 |
| 5,628,404 | A | * | 5/1997 | Hendrix | 206/524.8 |
| 5,839,582 | A | | 11/1998 | Strong et al. | |
| 5,881,881 | A | * | 3/1999 | Carrington | 206/524.8 |
| 5,931,189 | A | | 8/1999 | Sweeney et al. | |
| 5,996,800 | A | | 12/1999 | Pratt | |
| 6,021,624 | A | | 2/2000 | Richison et al. | |
| 6,039,182 | A | | 3/2000 | Light | |
| 6,056,439 | A | | 5/2000 | Graham | |
| 6,059,457 | A | | 5/2000 | Sprehe et al. | |
| 6,070,397 | A | | 6/2000 | Bachhuber | |
| 6,116,781 | A | | 9/2000 | Skeens et al. | |
| 6,149,304 | A | | 11/2000 | Hamilton et al. | |
| 6,357,915 | B2 | | 3/2002 | Anderson | |
| 6,371,643 | B2 | | 4/2002 | Saad et al. | |
| 6,575,191 | B2 | | 6/2003 | Skeens et al. | |
| 6,581,641 | B2 | | 6/2003 | Skeens et al. | |
| 6,604,634 | B2 | * | 8/2003 | Su | 206/524.8 |
| 6,634,384 | B2 | | 10/2003 | Skeens et al. | |
| 6,715,644 | B2 | | 4/2004 | Wilford | |
| 6,799,680 | B2 | | 10/2004 | Mak | |
| 6,932,509 | B2 | | 8/2005 | Shah et al. | |
| 7,290,660 | B2 | | 11/2007 | Tilman et al. | |
| 7,328,730 | B2 | * | 2/2008 | Vilalta et al. | 141/326 |
| 7,331,715 | B2 | * | 2/2008 | Miller et al. | 383/103 |
| 2003/0017238 | A1 | * | 1/2003 | Haamer | 426/241 |
| 2003/0024847 | A1 | | 2/2003 | Malaspina | |
| 2003/0102245 | A1 | | 6/2003 | Wang | |
| 2003/0136798 | A1 | | 7/2003 | Wilford | |
| 2003/0155269 | A1 | | 8/2003 | Lee | |
| 2004/0000501 | A1 | | 1/2004 | Shah et al. | |
| 2004/0000502 | A1 | * | 1/2004 | Shah et al. | 206/524.8 |
| 2004/0000503 | A1 | | 1/2004 | Shah et al. | |
| 2004/0007494 | A1 | | 1/2004 | Popeil et al. | |
| 2004/0050745 | A1 | | 3/2004 | Lee et al. | |
| 2004/0223667 | A1 | | 11/2004 | Shah et al. | |
| 2004/0234170 | A1 | | 11/2004 | Pawloski et al. | |
| 2005/0025396 | A1 | | 2/2005 | ErkenBrack | |
| 2005/0036718 | A1 | | 2/2005 | Wu et al. | |
| 2005/0065007 | A1 | | 3/2005 | Wu et al. | |
| 2005/0172577 | A1 | | 8/2005 | Oltrogge | |
| 2005/0205455 | A1 | | 9/2005 | Harrison | |
| 2005/0238263 | A1 | | 10/2005 | Ping | |
| 2005/0244083 | A1 | | 11/2005 | McMahon et al. | |
| 2005/0286808 | A1 | | 12/2005 | Zimmerman et al. | |
| 2006/0050999 | A1 | | 3/2006 | Blythe et al. | |
| 2006/0073291 | A1 | | 4/2006 | Wu | |
| 2006/0120632 | A1 | | 6/2006 | Han | |

FOREIGN PATENT DOCUMENTS

| | | | | |
|---|---|---|---|---|
| JP | 01279073 | A | * | 11/1989 |
| JP | 02233368 | A | | 2/1990 |
| JP | 03212355 | A | | 9/1991 |
| JP | 03212355 | A | * | 9/1991 |
| WO | WO 2004/002840 | | | 1/2004 |
| WO | WO 2004/002841 | | | 1/2004 |
| WO | WO 2004/002850 | | | 1/2004 |
| WO | WO 2005/000706 | | | 1/2005 |
| WO | WO 2005/016774 | | | 2/2005 |
| WO | WO 2005/040005 | | | 5/2005 |

* cited by examiner

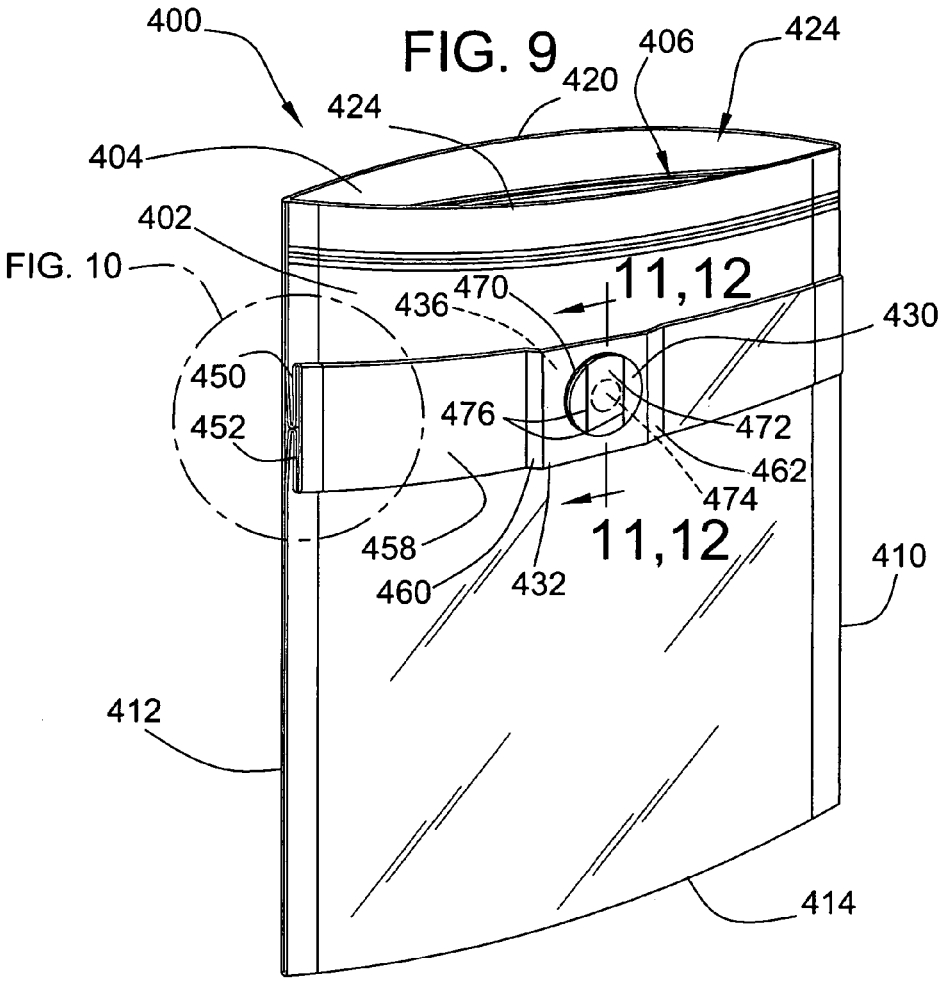
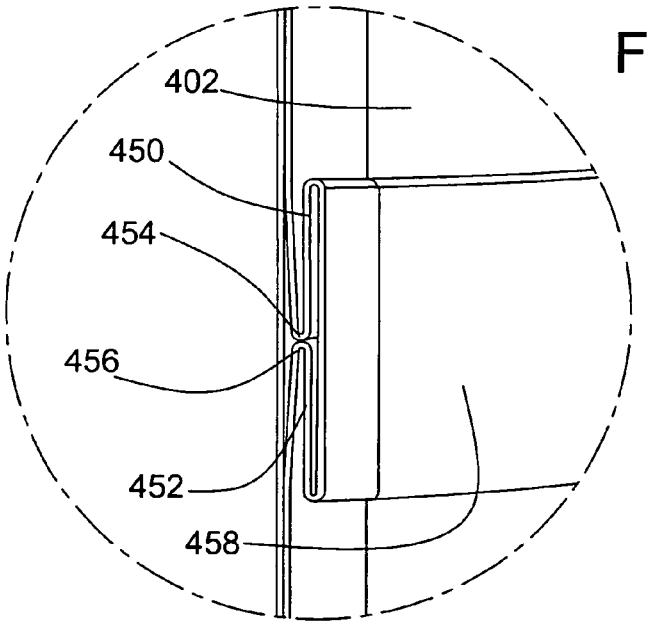
FIG. 10

STORAGE BAG WITH FLUID SEPARATOR

FIELD OF THE INVENTION

This invention pertains generally to storage containers and more particularly to flexible, thermoplastic, storage bags designed to be sealed and evacuated. The invention finds particular applicability in the field of food storage.

BACKGROUND OF THE INVENTION

Storage bags are commonly used for a variety of purposes such as storing food items. Such storage bags are typically made from a flexible, low cost, thermoplastic material that defines an interior volume into which food items can be inserted. To preserve the inserted food, the storage bag may also include a distinct closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, it is known to provide a one-way valve element or other evacuation device communicating with the interior volume. The one-way valve element allows for the evacuation of trapped air while preventing the ingress of air from the surrounding volume into the interior volume. The one-way valve element may be activated in various ways such as, for example, by applying compressive pressure to the flexible sidewalls to force air from the interior volume or by engaging a nozzle of a vacuum source to or about the one-way valve element to draw air from the interior volume.

Often, the stored food items contain fluids or juices that, during evacuation, may be drawn into and thereby contaminate the valve element. As will be appreciated, the contaminated valve element may result in sanitary issues and may not function properly. Additionally, the fluids or juices may also be drawn through the valve element and into the vacuum source or otherwise ejected into the environment, causing additional sanitary or operational problems. The inventive storage bag remedies these and other problems.

BRIEF SUMMARY OF THE INVENTION

The invention provides a storage bag configured with a separator that causes separation of fluids and juices from air being evacuated through the one-way valve element. The valve element communicates with the interior volume via the separator such that evacuating air must pass through the separator. By removing fluids and juices from the evacuating air before the air passes through the one-way valve element, contamination of the valve element is avoided.

In an aspect of the invention, the separator is configured as an excess piece of flexible material that sealingly connects the valve element to a smooth sidewall of the storage bag. The flexible separator is adjustable between a collapsed position and an expanded position. In the collapsed position, the valve element is generally located within the plane of the sidewall to enable compact stacking and folding of multiple bags. In the expanded position, the separator expands to define a chamber that raises or spaces the valve element from the sidewall. As air is drawn through the chamber, fluids and juices are caused to gravitationally separate from the evacuating air, condense together, and are returned to the interior volume.

An advantage of the invention is that it provides a storage bag configured to prevent contamination of a one-way valve element by separating fluids from evacuating air. Another advantage is that, in an aspect, the bag including the separator is made from flexible material to allow collapsing and folding of the bag for compact packaging during distribution. These and other advantages and features of the invention will become apparent from the detailed description and the accompanying drawings.

BRIEF DESCRIPTION OF THE DRAWINGS

FIG. 9 is a perspective view of another embodiment of the storage bag having a one-way valve element and a separator for separating fluids and juices from evacuating air, where the separator is provided by forming opposing Z-folds into the sidewall of the bag.

FIG. 10 is a detailed view of the indicated portion of FIG. 9, illustrating the arrangement of the opposing Z-folds.

DETAILED DESCRIPTION OF THE INVENTION

Figure 1:
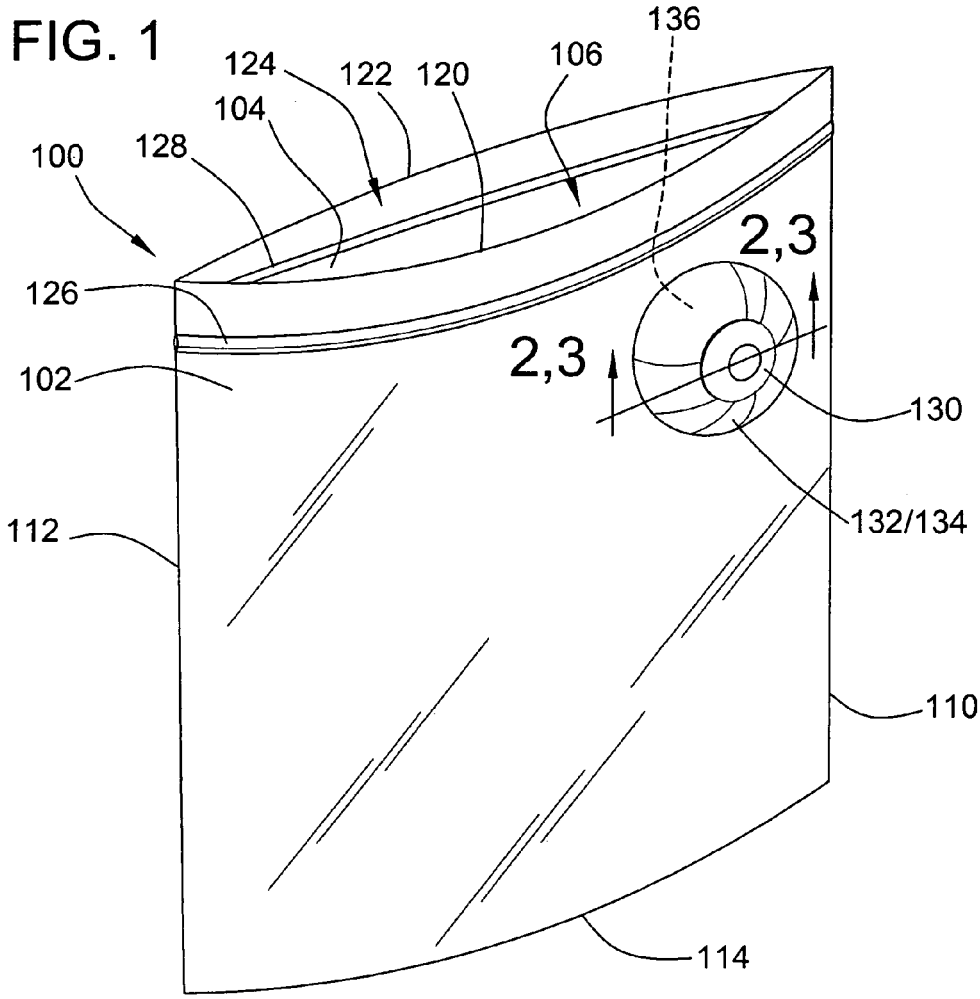
FIG. 1 is a perspective view of a storage bag designed in accordance with the teachings of the invention, the storage bag having a one-way valve element and a separator for separating fluids and juices from evacuating air.

Now referring to the drawings, wherein like reference numbers refer to like elements, there is illustrated in FIG. 1 a storage bag 100 for storing items such as food stuffs. In the illustrated embodiment, the storage bag 100 is made from a first sidewall 102 and an opposing second sidewall 104 overlying the first side wall to define an interior volume 106 therebetween. The first and second sidewall 102, 104 are joined along a first side edge 110, a parallel or non-parallel second side edge 112, and a closed bottom edge 114 that extends between the first and second side edges. The first and second sidewalls 102, 104 are preferably made from a flexible or pliable thermoplastic material formed or drawn into a smooth, thin walled sheet. Examples of suitable thermoplastic material include high density polyethylene, low density polyethylene, polypropylene, ethylene vinyl acetate, nylon, polyester, polyamide, ethylene vinyl alcohol, and can be formed in single or multiple layers. The thermoplastic material can be transparent, translucent, opaque, or tinted. Furthermore, the material used for the sidewalls can be a gas impermeable material. The sidewalls 102, 104 can be joined along the first and second side edges 110, 112 and bottom edge 114 by any suitable process such as, for example, heat sealing.

For accessing the interior volume 106, the top edges 120, 122 of the first and second sidewalls 102, 104 opposite the bottom edge 114 remain un-joined to define an opening 124. To seal closed the opening 124, first and second interlocking fastening strips 126, 128 can be attached to the interior surfaces of the respective first and second sidewalls 102, 104. The first and second fastening strips 126, 128 extend generally between the first and second side edges 110, 112 parallel to and spaced below the top edges 120, 122. In other embodiments, the bag 100 can include a movable slider straddling the fastening strips 126, 128 to facilitate occluding and deoccluding of the opening 124. In other embodiments, instead of fastening strips, the first and second sidewalls can be configured with pressure sensitive or cold seal adhesives (such as those disclosed in U.S. Pat. No. 6,149,304, herein incorporated by reference in its entirety), heat-sealing, or cling, to seal the open top edge.

To evacuate the bag of latent or entrapped air after the opening has been sealed closed, a one-way valve element 130 is provided that communicates with the interior volume 106. In one embodiment, the one-way valve element 130 is configured to open under an applied pressure differential thereby allowing air from the interior volume 106 to escape and to close after elimination or reduction of the pressure differential thereby preventing the ingress of environmental air into the interior volume. In accordance with the invention, the one-way valve element is connected to the rest of the bag via a separator to separate fluids and juices from evacuating air.

Figure 2:
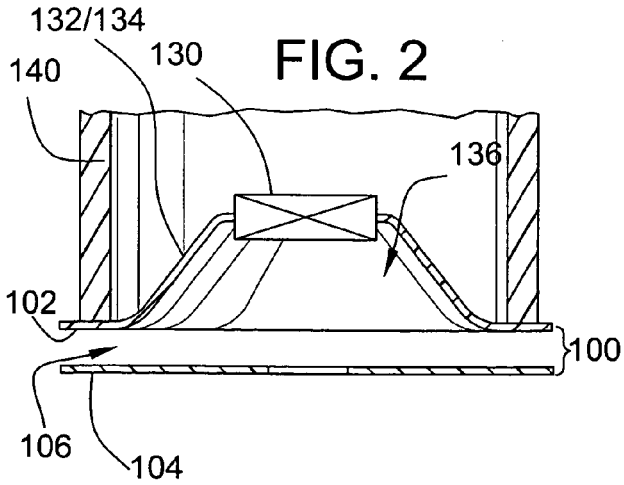
FIG. 2 is a cross-sectional view through the valve element and the separator as taken along line 2-2 of FIG. 1, the valve element and separator being acted upon by a nozzle during evacuation and the separator shown in an expanded position.

As illustrated in FIGS. 1 and 2, the separator 132 is formed from a piece of excess material in the shape of a thin-walled dome 134 that is joined along its base to a first sidewall 102 and protrudes outward therefrom. The thin-walled dome 134 of excess material surrounds and defines an enclosed chamber 136 that communicates with the interior volume 106. The valve element 130 is sealingly joined to the apex of the dome 134 and is thereby connected to and spaced-apart from the first sidewall 102.

Referring to FIG. 2, air drawn or forced from the interior volume 106 must pass through the chamber 136 to reach and escape through the valve element 130. In the chamber 136, fluids and juices entrained in the evacuating air from the interior volume are removed by gravitational separation and returned to the interior volume 106. More specifically, the pressure, velocity, and generally vertical direction of the air being drawn or forced through the chamber 136 interact to cause the fluids and juices to condense into droplets that can remain in the chamber during evacuation and return under the influence of gravity to the interior volume 106. This is facilitated by the greater density of the fluids as compared to air and due to the resulting condensation droplets' inability to traverse the chamber. Additionally, contacting the evacuating air generally along the inner surfaces of the sidewalls 102, 104 and causing the evacuating air to turn towards the valve element 130 along the inner surface of the excess material making up the separator 132 facilitates separation and condensation of the fluids and juices. Hence, the evacuating air actually passing through the valve element 130 is relatively devoid of entrained fluids and juices in liquid or droplet form, thereby preventing contamination of the valve element. The size and shape of the chamber 136 can be optimized with respect to the shape of the interior volume 106, first sidewall 102, and valve element 130 to maximize the separation of fluids and juices.

Figure 3:
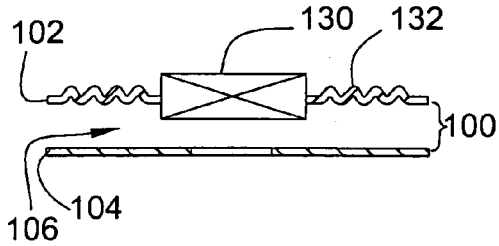
FIG. 3 is a cross-sectional view through the valve element and the separator as taken along line 3-3 of FIG. 1, the separator shown in a collapsed position.

Referring to FIGS. 2 and 3, to allow for folding and packaging of the storage bag 100, the separator 132 is preferably adjustable between a collapsed position and an expanded position. The separator 132 can be made from the same or similar flexible or pliable material as the first or second sidewalls 102, 104. When the bag 100 is placed atop a generally flat surface, the separator 132 can collapse from the dome shape and bunch or fold together about the valve element 130 so that the valve element is generally located within the plane of the first sidewall 102, as shown in FIG. 3. When the separator 132 is in the collapsed position, the chamber is by and large eliminated. Hence, the first and second sidewalls 102, 104 are generally parallel and can be pressed together to eliminate the interior volume 106 and flatten the bag 100. As will be appreciated, multiple flattened bags can be compactly stacked atop one-another for packaging and distribution.

In one embodiment, to make the separator 132 "pop-up" and thereby place the separator into its expanded position, referring back to FIG. 2, a pressure differential is applied across the first sidewall 102 proximate the valve element 130. The pressure differential can be generated by the same vacuum source used to evacuate air from the bag 100 or from a different vacuum source. Specifically, a generally tubular nozzle 140 is placed against the first sidewall 102 generally about the valve element 130 and the separator 132. The first end of the nozzle 140 can be pressed against the first sidewall 102 while the second end of the nozzle communicates with a vacuum source. When the vacuum source is activated, the pressure differential between the interior volume 106 and the nozzle 140 causes the separator 132 to expand and protrude in the shape of the thin-walled dome 134 from the first sidewall 102. The expanding separator 132 defines the chamber 136 that raises or spaces the valve element 130 apart from the first sidewall 102 and in which the separation of fluids and juices from the evacuating air occurs. After evacuation of the interior volume 106, the valve element 130 will close as the pressure differential is reduced or eliminated and the nozzle 140 can be removed. After removal of the nozzle, the separator 132 can be collapsed by vacuum from inside the bag or by external hand pressure to force the remaining air in the chamber 136 back into the interior volume. In other applications, it will be appreciated that, rather than using a nozzle and an attached vacuum source, evacuation of the interior volume can occur by pressing the first and second sidewalls together by hand thereby forcing air into and expanding the separator.

Referring to FIGS. 2 and 3, the excess material for the separator 132 is preferably provided from the same sheet of material as used for the first sidewall 102. For example, the pliable material of the first sidewall 102 can be stamped, thermoformed or otherwise displaced or formed to provide the dome-shape 134 of the separator 132. Hence, the separator 132 is integral with the first sidewall 102 and can likewise be made of any suitable thermoplastic material such as, for example, high density polyethylene, low density polyethylene, polypropylene, ethylene vinyl acetate, and can be formed in single or multiple layers.

Figure 4:
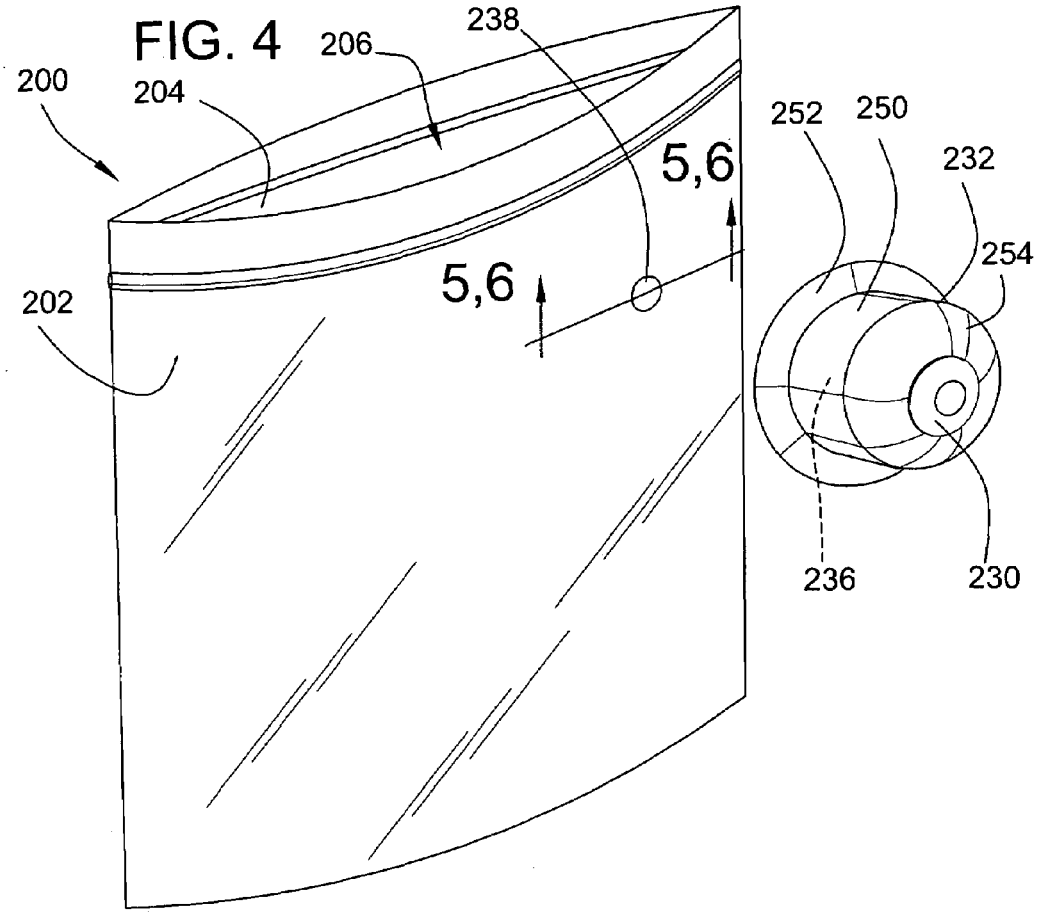
FIG. 4 is an exploded view of another embodiment of a storage bag having a one-way valve element and a separator for separating fluids and juices from evacuating air.

Referring to FIG. 4, there is illustrated another embodiment of a storage bag 200 wherein the separator 232 has a generally tubular shape and is formed separately from the material of the first sidewall 202. Specifically, in the illustrated embodiment, the separator 232 is formed as a cylindrically-shaped, tubular sleeve 250 of flexible or pliable thin-walled material that extends between a flanged base 252 and a closed cap 254. The sleeve 250 can be made from any suitable material including, for example, high density polyethylene, low density polyethylene, polypropylene, ethylene vinyl acetate, and can be formed in single or multiple layers. Moreover, the type of material can be the same as or different from the type of material used for the first and second sidewalls 202, 204. The tubular sleeve 250 defines and encloses a chamber 236 in which separation of fluids and juices from evacuating air can occur, as described above. The one-way valve element 230 is sealingly joined to the closed cap 254 to communicate with the chamber 236.

To operatively join the tubular-shaped separator 232 to the rest of the bag 200, a hole 238 is disposed through the first sidewall 202 to access the interior volume 206. The flanged base 252 is then placed against the first sidewall 202 so that the hole 238 aligns with the chamber 236 and the one-way valve element 230 is spaced-apart from the first sidewall. Any suitable method can be used to join the flanged base 252 to the first sidewall 202 including, for example, adhesives or heat sealing. Evacuating air from the interior volume 206 then passes across the hole 238 into the chamber 236 where separation occurs and exits through the valve element 230.

Figure 5:
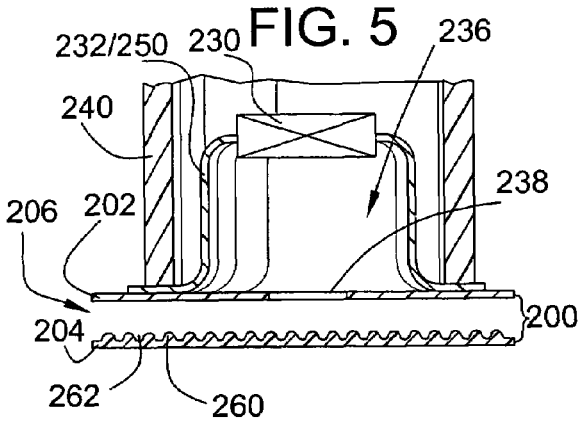
FIG. 5 is a cross-sectional view through the valve element and separator taken along line 5-5 of FIG. 1, the valve element and separator being acted upon by a nozzle during evacuation and the separator shown in an expanded position.
Figure 6:
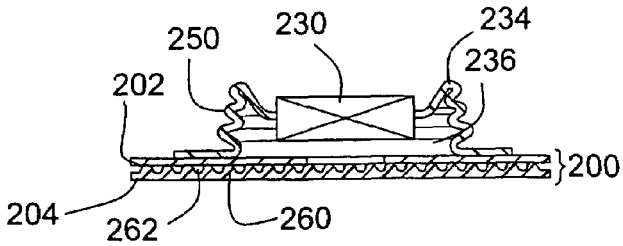
FIG. 6 is a cross-sectional view through the valve element and the separator as taken along line 6-6 of FIG. 4, the separator shown in a collapsed position.

Referring to FIGS. 5 and 6, the tubular-shaped separator 232 is preferably configured to switch between an expanded position and a collapsed position for simplifying packaging and distribution. As illustrated in FIG. 6, in the collapsed position, the excess material comprising the tubular sleeve 250 bunches up about the valve element 230 which is generally adjacent the first sidewall 202. When the separator 232 is in the collapsed position, the chamber 236 is by and large eliminated. Additionally, the first sidewall 202 can be flattened against the second sidewall 204 to substantially eliminate the interior volume.

Referring to FIG. 5, to expand the separator 232 and recreate the chamber 236, a pressure differential is applied across the first sidewall 202 proximate the valve element 230. The pressure differential may be created by applying a nozzle 240 attached to a vacuum generating device about the valve element 230. When the vacuum generating device is activated, the evacuating air drawn through the hole 238 expands the separator 232 into the tubular sleeve 250 thereby lifting and spacing the valve element 230 from the first sidewall 202. Hence, fluids and juices entrained in the evacuating air can be separated by the process described above within the chamber 236 before the air exits through the one-way valve element 230.

As illustrated in the embodiment of FIGS. 5 and 6, the bag 200 can include other features to facilitate evacuation of air from the interior volume 206. For example, the interior surface of the second sidewall 204 can include a plurality of elongated ribs 260 protruding toward the first sidewall 202. The ribs 260 define a plurality of channels 262 that can extend in any suitable pattern partially or completely across the interior surfaces of the bag 200. As will be appreciated by those of skill in the art, the inclusion of channels 262 can direct air toward the valve element 230 from various regions within the bag 200 during evacuation. Furthermore, the channels 262 are preferably sized so that the flexible material comprising the sidewalls 202, 204 will not clog the channels or otherwise block the flow of air toward the valve even when the sidewalls are collapsed together. Of course, it should be further appreciated that alternatively the channels 262 could be defined by grooves formed into the interior surface instead of ribs. Additionally, the channels 262 can be defined in either or both of the sidewalls.

Figure 7:
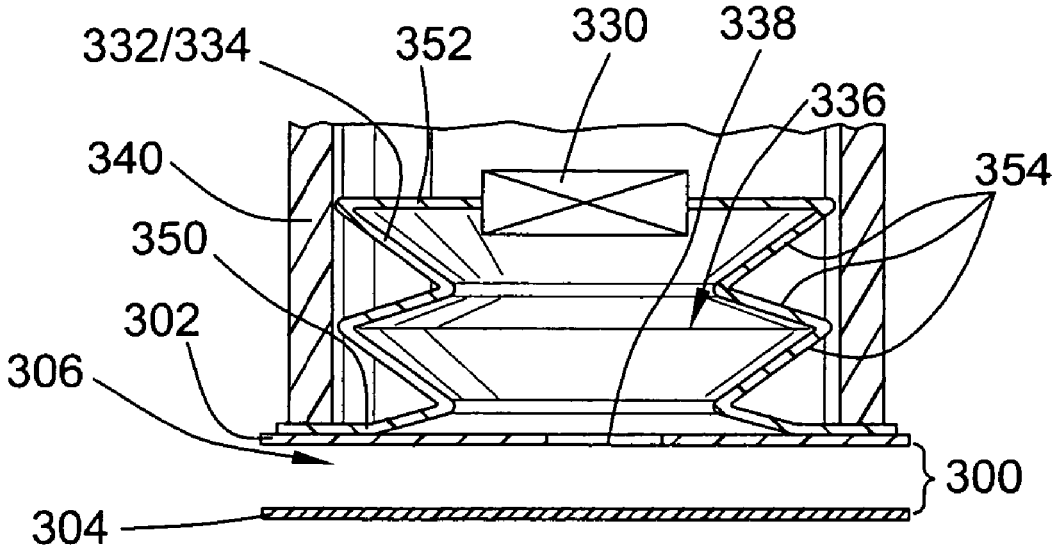
FIG. 7 is a cross-sectional view of another embodiment of the storage bag as taken through the valve element and the separator as being acted upon by a nozzle during evacuation, the separator shown in the expanded position.
Figure 8:
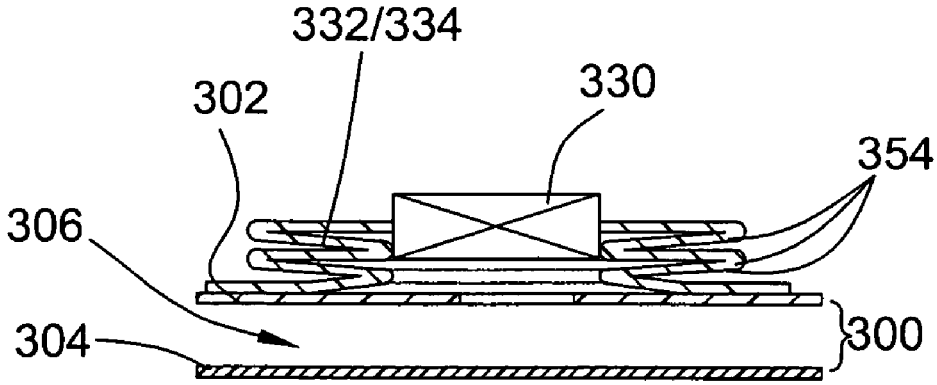
FIG. 8 is a cross-sectional view of the embodiment of the storage bag illustrated in FIG. 7 as taken through the valve element and the separator, the separator shown in the collapsed position.

Illustrated in FIGS. 7 and 8 is another embodiment of a storage bag 300 wherein the separator 332 is shaped as a bellows 334 and formed separately from the material of the first sidewall 302. The bellows 334 is a generally cylindrical, thin-walled tube having an opened flanged base 350 and an opposing closed cap 352. The tubular bellows 334 defines and encloses a chamber 336 in which separation of fluids and juices from evacuating air can occur, as described above. A one-way valve element 330 is sealingly joined to the end cap 352. A plurality of annular pleats 354 are formed into the tubular sidewall which allow the bellows 334 to expand and contract with respect to the first sidewall 302. The bellows 334 can be made from any suitable material including, for example, high density polyethylene, low density polyethylene, polypropylene, ethylene vinyl acetate, and can be formed in single or multiple layers.

To operatively connect the bellows with the rest of the bag 300, the flanged base 350 is adjacent to the first sidewall 302 about a hole 338 disposed therein and attached to the first sidewall by adhesives or heat-sealing. When the separator 332 is in the collapsed position, as illustrated in FIG. 8, the chamber 336 is substantially eliminated and the valve element 330 is moved generally adjacent to the first sidewall 302. The separator 332 is collapsed by folding together the annular pleats 354 which create the bellows 334. Moreover, the first and second sidewalls 302, 304 can be flattened together to eliminate the interior volume 306. When the separator 332 is in the expanded position, as achieved in FIG. 7 by expanding the bellows 334, the chamber 336 is created and raises or spaces the valve element 332 away from the first sidewall 302. Air from the interior volume 306 can pass through the hole 338 to enter the chamber 336 where fluids and juices can separate out in the above-described manner. The air can then exit the chamber 336 through the one-way valve element 330. To expand the separator 332 for enlarging the chamber 336, a pressure differential can be applied across the first sidewall 302 by applying a nozzle 340 communicating with a vacuum source about the separator and valve element 330.

Referring to FIGS. 9 and 10, there is illustrated another embodiment of a storage bag 400 wherein the separator is formed integrally with the first sidewall. In the illustrated embodiment, the bag 400 is produced by joining together a first sidewall 402 and a second sidewall 404 along a sealed first side edge 410, a parallel sealed second side edge 412, and a closed bottom edge 414 extending between the first and second side edges to define an interior volume 406. To access the interior volume 406, the top edges 420, 422 of the first and second sidewalls 402, 404 are not joined together and thereby provide an opening 424.

As illustrated in FIGS. 9, 10, 11, and 12, to create the separator 432, first and second opposing Z-folds 450, 452 are formed into the first sidewall 402 and extend parallel to each other generally between the first and second side edges 410, 412. The first and second Z-folds 450, 452 are arranged to provide parallel, adjoining first and second bends 454, 456 and are interconnected by a continuous strip of material 458 that is slightly spaced-apart from the plane of the first sidewall 402 by the Z-folds. The adjoining bends 454, 456 are located beneath the strip 458 of material. Two parallel, spaced-apart seals 460, 462 are formed into the strip 458 approximately midway between the first and second side edges 410, 412 to outline the protruding, square-shaped separator 432. The separator 432 encloses and defines an expandable and collapsible chamber 436 in which separation of fluids and juices from evacuating air can occur. The one-way valve element 430 is sealingly joined to the separator 432 to communicate with the chamber 436.

Figure 11:
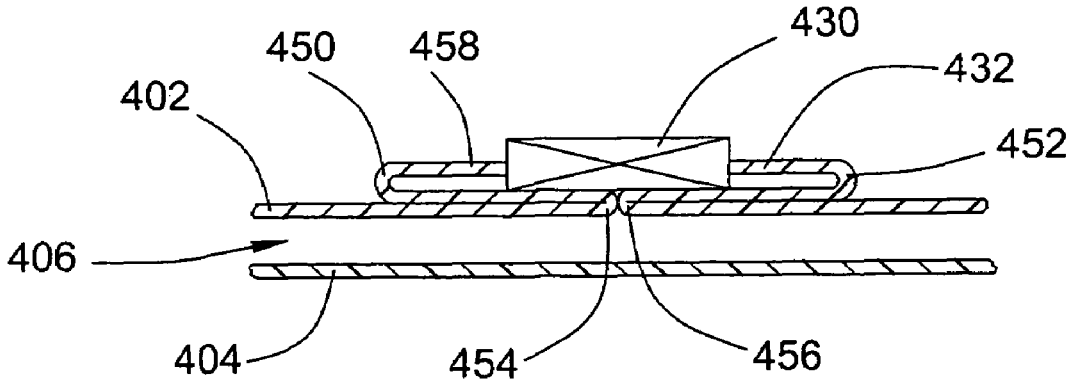
FIG. 11 is a cross-sectional view through the valve element and separator taken along line 11-11 of FIG. 9 with the separator shown in the collapsed position.
Figure 12:
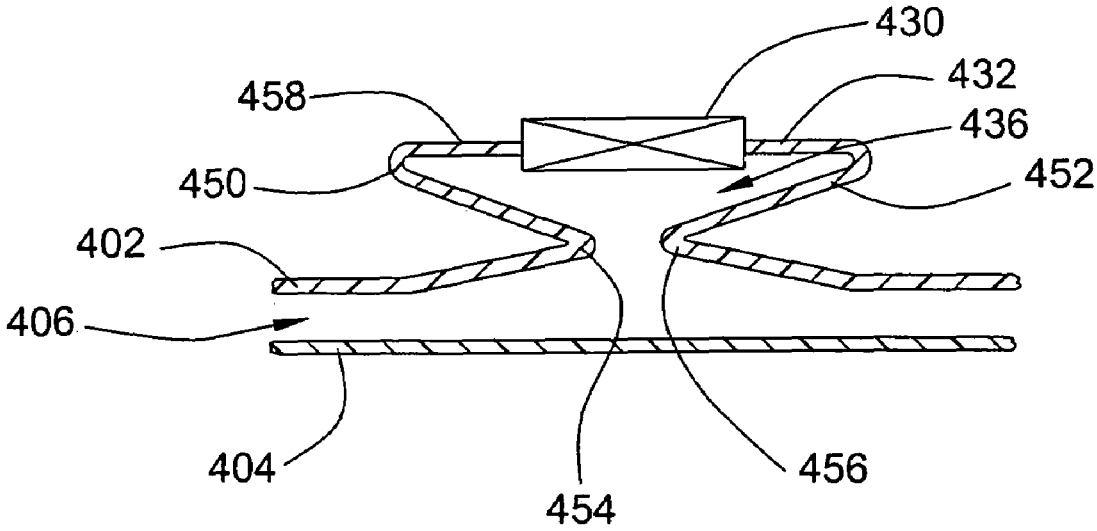
FIG. 12 is a cross-sectional view through the valve element and separator taken along line 12-12 of FIG. 9 with the separator shown in the expanded position.

Referring to FIGS. 11 and 12, it will be appreciated that, during evacuation of the interior volume, air must pass between the adjoining bends 454, 456 of the Z-folds 450, 452 to enter the separator 432. Once in the separator 432, the evacuating air will cause the chamber 436 to expand by slightly raising the strip 458 with respect to the adjoining bends 454, 456. Fluids and juices can separate from the evacuating air inside the expanded chamber 436 in the above-described fashion and be returned to the interior volume 406 while the air exits through the one-way valve element 430.

The one-way valve element 130, 230, 330, 430 can have any suitable design. For example, referring to the embodiment illustrated in FIG. 9, the one-way valve element 430 includes a flexible base layer 470 that cooperates with a resilient top layer 472 to open and close the valve element. The base and top layers 470, 472 can be made from any suitable material such as, for example, thermoplastic film. Disposed through the center of the base layer 470 is an aperture 474, thus providing the base layer with an annular shape. The top layer 472 is tautly stretched over and adhered to the base layer 470 by parallel strips of adhesive 476 that extend along either side of the aperture 474, thereby covering the aperture with the top layer and forming a channel between the adhesive strips. The base layer 470 and top layer 472 are then adhered over a hole disposed through the separator 432 for accessing the chamber 436.

As will be appreciated by those of skill in the art, when a pressure differential is created across the valve element 430, the top layer 472 will be partially separated from the base layer 470 thereby creating a channel or space between the base layer 470 and the top layer 472. Air escaping the interior chamber 436 can enter into the channel between the base layer 470 and the top layer 472 and thereby escape into the environment. Of course, in other embodiments, the one-way valve element can have a different construction. For example, in another embodiment, the base layer 470 is eliminated and is not part of the valve element. In other embodiments, the valve element may be a rigid body with a translating valve disk that opens and closes a hole disposed through the body.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A storage bag comprising:

first and second flexible sidewalls, the sidewalls joined along a first side edge, a parallel second side edge, a closed bottom edge, the top edges of the sidewalls unjoined to form an opening for accessing an interior volume;

first and second interlocking closure strips attached to the respective first and second sidewalls proximate the opening;

a one-way valve element communicating with the interior volume;

a separator sealingly connecting the one-way valve element to the first sidewall and being operative to separate fluids and juices entrained in evacuating air during evacuation of the internal volume such that the air that passes through the valve element is relatively devoid of entrained fluids and juices in liquid or droplet form;

the valve element is positioned medial of the separator;

wherein the separator is adjustable between a collapsed position and an expanded position, wherein:

the separator spaces the valve element apart from the first sidewall when the separator is in the expanded position; and the separator and the valve element coincide with an outer surface of the first sidewall when the separator is in the collapsed position.

2. The storage bag of claim 1, wherein, in the expanded position, the separator defines a chamber communicating between the interior volume and the valve element.

3. The storage bag of claim 1, wherein the separator is formed as a thin-walled dome having a base joined to the first sidewall and an apex joined to the valve element.

4. The storage bag of claim 1, wherein the separator is formed as a generally tubular sleeve having a first end joined to the first sidewall and a second end joined to the valve element.

5. The storage bag of claim 1, wherein the separator is formed as an expanding and contracting bellows having a first end joined to the first sidewall and a second end joined to the valve element.

6. The storage bag of claim 1, wherein the separator is comprised of a flexible material.

7. The storage bag of claim 1, wherein the separator is integrally formed from the sidewall material.

8. The storage bag of claim 1, wherein the separator is separately formed and attached to the first sidewall.

9. The storage bag of claim 8, wherein the separator is attached to the first sidewall by heat-sealing.

10. The storage bag of claim 8, wherein the separator is attached to the first sidewall by adhesive.

11. The storage bag of claim 1, wherein the first and second sidewalls comprise a gas-impermeable material.

12. The storage bag of claim 1, wherein each sidewall is comprised of a material selected from the group consisting of high density polyethylene, low density polyethylene, polypropylene, ethylene vinyl acetate, nylon, polyester, polyamide, and ethylene vinyl alcohol.

13. The storage bag of claim 1, wherein at least one sidewall includes a plurality of channels allowing for the passage of air toward the valve element.

14. The storage bag of claim 1, wherein formed into the first sidewall are first and second Z-folds, the first and second Z-folds interconnected by a strip of material spaced-apart from the sidewall.

15. The storage bag of claim 14, wherein a first seal and a second seal are disposed across the first and second Z-folds and across the strip, the separator being provided by the portions of the first and second Z-folds and of the strip between the first and second seals.

16. The storage bag of claim 15, wherein the first and second opposing Z-folds form adjoining first and second bends between the first sidewall and the strip.

17. A method of evacuating a storage bag comprising:

providing a bag including a pair of sidewalls joined together to define an interior volume, an opening for accessing the interior volume, first and second interlocking closure strips attached to the sidewalls proximate the opening, a one-way valve element communicating with the interior volume, and a separator protruding outwardly from a first sidewall and sealingly connecting the valve element to the first sidewall, the valve element is positioned medial of the separator, the separator being adjustable between a collapsed position and an expanded position, and wherein the separator spaces the valve element outwardly of and apart from the first sidewall when in the expanded position and the separator and the valve element coincide with an outer surface of the first sidewall when the separator is in the collapsed position;

closing the opening;

transferring air from the interior volume to the separator;

separating fluids from the air in the separator and returning separated fluid to the interior volume; and exhausting air from the separator through the valve element.

18. The method of claim 17, further comprising the step of expanding a chamber defined by the separator upon transferring air to the separator.

19. The method of claim 17, wherein the step of separating fluids from the air occurs by gravitational separation.

* * * * *